US007712938B2

(12) United States Patent
Behr et al.

(10) Patent No.: US 7,712,938 B2
(45) Date of Patent: May 11, 2010

(54) SOCKET FOR A LAMP

(75) Inventors: Gerhard Behr, Altheim (DE); Peter Helbig, Sontheim/Brenz (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 217 days.

(21) Appl. No.: 11/886,628

(22) PCT Filed: Feb. 9, 2006

(86) PCT No.: PCT/DE2006/000224

§ 371 (c)(1),
(2), (4) Date: Sep. 18, 2007

(87) PCT Pub. No.: WO2006/097059

PCT Pub. Date: Sep. 21, 2006

(65) Prior Publication Data

US 2009/0080212 A1 Mar. 26, 2009

(30) Foreign Application Priority Data

Mar. 18, 2005 (DE) ..... 10 2005 013 046

(51) Int. Cl.
*H01R 33/06* (2006.01)
*F21V 7/00* (2006.01)

(52) U.S. Cl. ..... 362/549; 362/548; 362/507; 362/652; 439/36

(58) Field of Classification Search ..... 362/652, 362/657, 658, 659, 655, 548, 549; 439/36
See application file for complete search history.

(56) References Cited

U.S. PATENT DOCUMENTS 5,669,701 A * 9/1997 Lin ..... 362/657

FOREIGN PATENT DOCUMENTS

| | | |
|---|---|---|
| DE | 10 2004 007 150 | 8/2005 |
| EP | 0 655 810 | 5/1995 |
| EP | 0 655 811 | 5/1995 |
| EP | 0 713 998 | 5/1996 |
| JP | 07 249465 | 1/1996 |

* cited by examiner

*Primary Examiner*—Ismael Negron

(57) ABSTRACT

A socket for a vehicle lamp, including a base housing and at least two contact spring elements fixed in the base housing for housing and electrically contacting the lamp. The contact spring elements of the socket housing are fixed to the base housing by means of a base slide having a slot recess for receiving a leg of a first contact spring element, and an abutment surface for contacting a leg of the second contact spring elements.

17 Claims, 7 Drawing Sheets

SOCKET FOR A LAMP

TECHNICAL FIELD

The invention relates to a base according to the preamble of patent claim 1, and to a lamp provided with such a base, according to the preamble of patent claim 17.

PRIOR ART

The base according to the invention can be used in principle, for a large number of lamps which have a base at one end. The main application area of the base, however, is likely to be in lamps for vehicle headlights which are inserted into a base via a pinched portion at one end.

A lamp with such a base is described, for example, in the applicant's application DE 10 2004 007 150, which was published after the priority date. These conventional lamps use a base with a metallic base part for accommodating the lamp. This metallic base part is inserted into a second, approximately cup-like plastic base part which is provided with two contact springs. These serve for making electrical contact with the lamp and are integrated in the second plastic base part by means of injection molding. The lamp-side end portions of the contact springs each contain a groove-like recess for accommodating power-supply leads of the lamp. In the case of this solution, the power-supply leads are inserted into the recesses of the contact springs and fixed by means of welding. The disadvantage with such lamps is that, on the one hand, an additional base part is required for accommodating the lamp and, on the other hand the operation for joining the lamp and contact springs, on account of the welding, requires high production outlay.

In order to simplify production, it is known, from the general prior art, for the contact springs to be configured, on the lamp side, with a clamp-like retaining region for accommodating the lamp and making electrical contact therewith. For this purpose, the lamp is inserted into the retaining region of the contact springs via a base-side pinched portion. This solution does indeed allow simplified production of the lamp since, in relation to DE 10 2004 007 150 from the prior art, no welding is necessary and it is possible to dispense with an additional base part for accommodating the lamp, but the configuration of the contact springs in the retaining region i.e. in the region in which the pinched portion of the lamp is accommodated and electrically contacted, means that this solution is not suitable for installation in the base by means of injection molding since, on account of the retaining region, encapsulation of the contact springs is only possible to a certain extent.

DESCRIPTION OF THE INVENTION

The object of the invention is to provide a base for a lamp, in particular for a vehicle lamp, a lamp provided with such a base and also a method of producing such a lamp, which, in relation to conventional solutions, allows simplified production, along with minimal outlay in terms of equipment, and also improved securing of the lamp on the base.

This object is achieved, in respect of the base, by the combination of features of claim 1, in respect of the lamp, by the features of claim 17. Particularly advantageous embodiments of the invention are described in the dependent claims.

The base according to the invention for a lamp, in particular for a vehicle lamp, has a base housing and at least two contact elements which are fixed in the base housing and are intended for accommodating the lamp and making electrical contact therewith. According to the invention, the contact elements of the base housing are fixed in a form-fitting and/or force-fitting manner by means of a base slide which can be secured in the base housing. The contact springs may thus be configured with a retaining region for accommodating the lamp and making electrical contact therewith, in which case the securing of the lamp in the base is significantly improved in relation to DE 10 2004 007 150 of the prior art. This solution allows simplified installation of the lamp in the base and production which is likewise significantly simplified in relation to the methods of the generic type, since it is possible to dispense with the separate operating steps for forming the weld.

The base slide is preferably a base part which can be inserted into the base housing and serves to fix the electrical contact elements following insertion into the base housing.

In the case of a preferred embodiment of the invention, the base slide can be introduced radially into an accommodating portion of the base housing.

The base slide along with the base housing preferably forms, at least in certain sections, a common base surface and/or side surface. On account of the base being closed off via the base slide, penetration of moisture and dirt into the base housing is effectively prevented and the service life of the lamp is significantly increased.

According to a particularly preferred exemplary embodiment, the base slide has a multiplicity of protrusions which can be introduced into recesses of the base housing. The protrusions make it easier to slide the base slide into the base housing.

It has proven to be particularly advantageous to form the recesses of the base housing as longitudinal grooves which extend at right angles to a longitudinal axis of the base housing.

In order to ensure that the base slide is installed in the correct position in the base housing, at least two longitudinal grooves are formed with a larger cross section than the other longitudinal grooves.

The base slide is preferably fixed on the base housing via a locking element. In the case of a particularly preferred exemplary embodiment, the locking element has at least one latching nose. Since all that is required, in order to install the contact elements in the base housing, is for the base slide to be pushed radially into the base housing, the production of the base is simplified to a considerable extent (so-called one-touch solution).

The base housing preferably has at least two recesses for accommodating the contact elements, the recesses being arranged such that the contact elements are located essentially parallel to one another. The recesses are arranged in the base housing such that contact springs are fixed between the base slide and the base housing. This facilitates the installation of the lamp in the base.

According to one exemplary embodiment of the invention, the contact elements used are contact springs, of which the spring legs are preferably angled in relation to one another.

The base slide has an essentially slot-like recess for accommodating a leg of the first contact spring and an abutment surface for a leg of the second contact spring. As a result, following installation of the base slide, the contact springs are retained in the base housing via this base slide and yielding of the contact spring as the lamp is plugged in is prevented.

The contact springs preferably have at least one spring leg which can be brought into force-fitting and/or form-fitting engagement with the lamp.

According to a preferred embodiment of the invention, the base can be brought into abutment with a headlight, in particular a vehicle headlight, directly or indirectly via an essentially annular flange. In order to avoid the penetration of moisture and dirt into the reflector housing of the headlight, a sealing element, for example a sealing disk may be arranged between the flange and the headlight housing. Instead of the sealing element, it is also possible to provide a spring element, for example made of metal, or a retaining ring for bridging tolerances of the headlight.

The base housing can preferably be rotated relative to the headlight and can be secured in a releasable manner thereon by means of a bayonet closure. This allows straightforward installation of the lamp on the vehicle headlight.

It is preferred to form the base housing, and/or the base slide from an electrically insulated material, preferably from a plastic. It is possible here for that region of the base which is arranged in the vicinity of the lamp vessel to consist of a high-temperature plastic material and for the base slide, which is subjected to less pronounced thermal loading, to be produced from a more cost-effective plastic.

The lamp according to the invention has a base and contact elements which are fixed in a form-fitting and/or force-fitting manner in the base housing by means of the base slide.

The method of producing a lamp according to the invention, the lamp being inserted into a base, and electrically contacted, via contact elements, has the following steps:

a) introducing the contact elements into the base housing;

b) pushing the base light into the base housing in order to fix the contact elements; and c) inserting the lamp into a retaining portion of the contact elements.

BRIEF DESCRIPTION OF THE DRAWINGS

The invention is explained in more detail hereinbelow with reference to a preferred exemplary embodiment. In the drawings:

FIG. 5 shows a three-dimensional illustration of the base as the base slide is being pushed in;

FIG. 6 shows a three-dimensional illustration of the base housing with the base slide pushed part of the way in.

PREFERRED IMPLEMENTATION OF THE INVENTION

The invention is explained hereinbelow by way of a vehicle-headlight discharge lamp which has a base at one end. As has already mentioned in the introduction, however, the base according to the invention is not in any way limited to such types of lamp.

Figure 1:
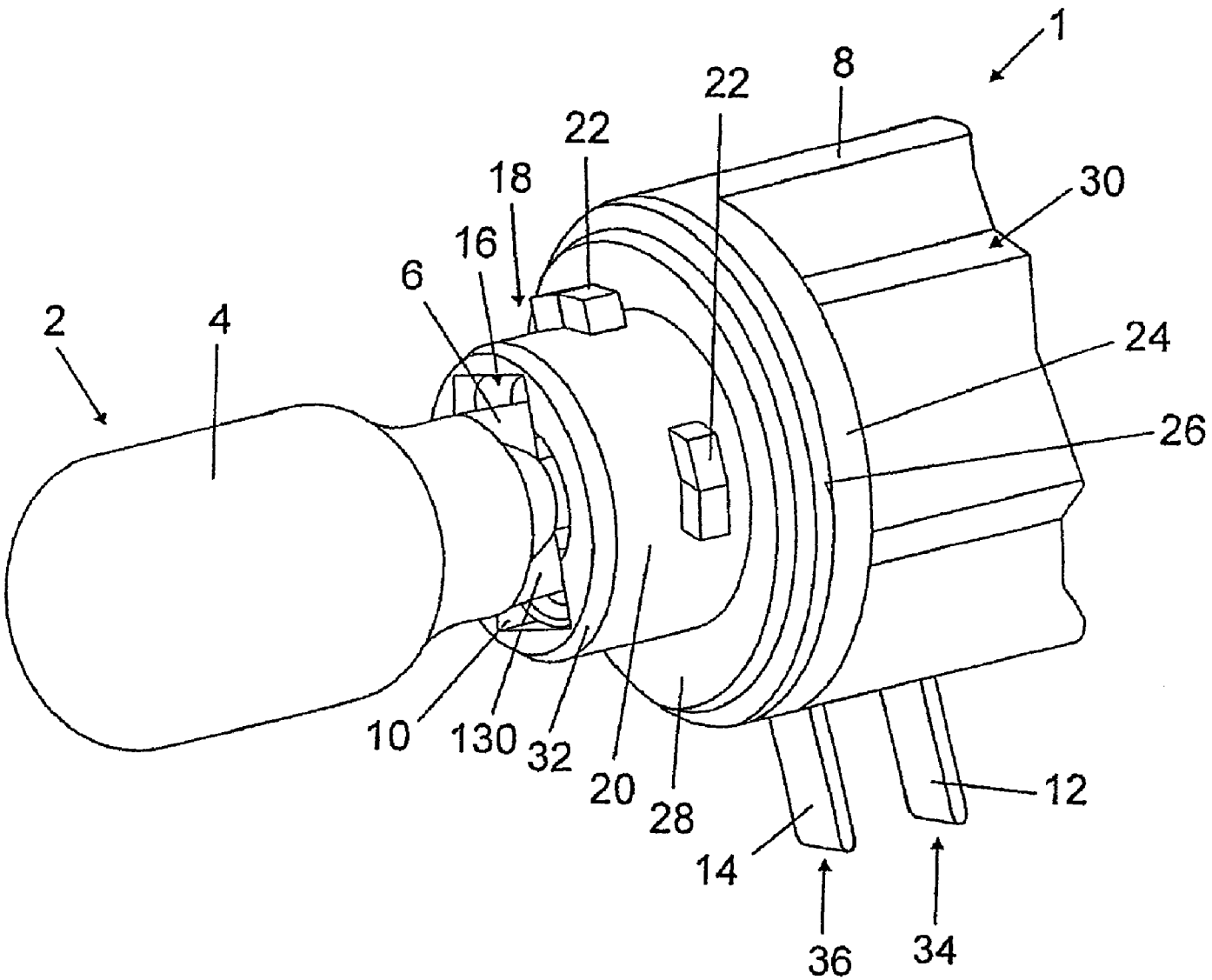
FIG. 1 shows a schematic illustration of a preferred exemplary embodiment of the base according to the invention with lamp inserted.

FIG. 1 shows a three-dimensional illustration of a base 1 according to the invention having a lamp 2 of type W16W, as are used for example in a vehicle headlight as an indicator or brake lamp inserted in it. Such a lamp 2 has a luminous means (not illustrated) which is connected to power-supply leads and is inserted into a lamp vessel 4 made of quartz glass. The lamp vessel 4 is sealed, and inserted into the base 1 via a pinched portion 6, which is located at one end and has an essentially rectangular cross section. This base has a base housing 8 which, on the lamp side, has an installation recess 10 for accommodating the lamp 2 in the base housing 8. The base housing 8 contains two contact elements which are configured as contact springs 12, 14 and, in the region of the installation recess 10 of the lamp 2, for a retaining portion 16 for accommodating the pinched portion 6 of the lamp 2 and are each electrically contacted to one of the two power-supply leads of the luminous means (not illustrated). The base housing 8 has, on the lamp side, an essentially cylindrical fastening portion 18 which has, on its outer circumferential surface 20 three radially projecting, approximately crosspiece-like connecting elements 22 (in FIG. 1, one of the connecting elements 22 is concealed by the fastening portion 18), which engage in corresponding retaining elements of a headlight and can be secured there (not illustrated). On the side which is directed away from the lamp vessel, the fastening portion 18 merges into a flange 24, which is annular at least in certain sections. This flange has an abutment surface 26 which, for the purpose of installing the base 1 in the headlight, can be brought into abutment against the headlight via a sealing disk 28 arranged on the fastening portion 18. In the installed state of the base 1, the sealing disk 28 is arranged between the flange 24 and headlight and prevents moisture and dirt from penetrating into the headlight. Following the flange 24, on the side which is directed away from the lamp vessel, the base housing 8 merges into an essentially box-like grip part 30. For the purpose of installing the base 1 on the headlight, the base is inserted into the headlight via the fastening portion 18 and secured on the headlight, by way of a rotary movement relative to that, by means of the connecting elements 22—in other words, the connecting elements 22, along with the retaining elements of the headlight, form a bayonet closure via which the base 1 can be secured in a releasable manner on the headlight. Introduction of the base 1 into the headlight is facilitated by a chamfer 32 formed on the end side of the fastening portion 18.

Figure 2:
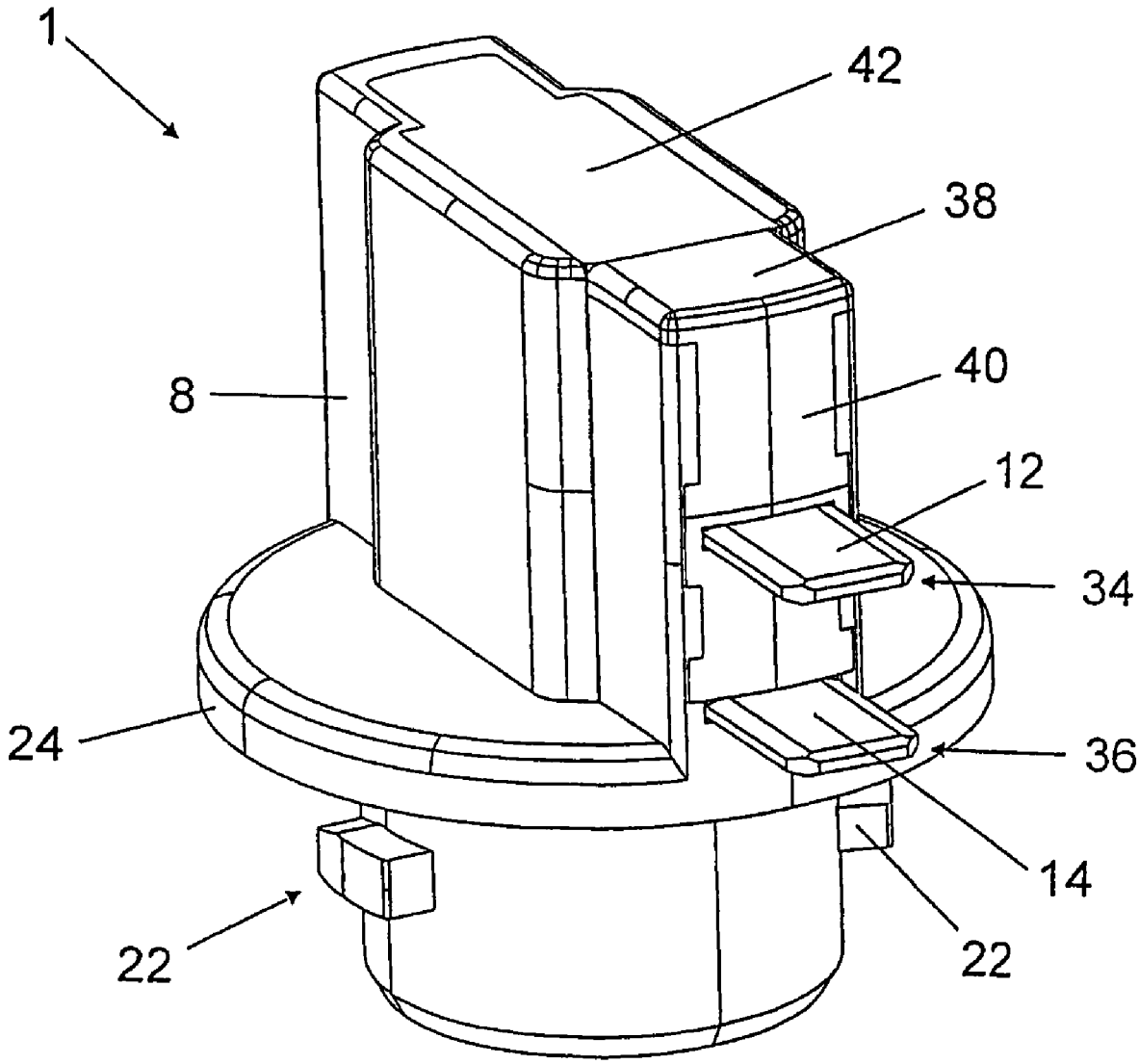
FIG. 2 shows a three-dimensional illustration solely of the base from FIG. 1.

According to FIG. 2, which shows a three-dimensional illustration solely of the base 1 from FIG. 1, the contact springs 12, 14 are arranged in the base housing 8 such that two end portions 34, 36 of the contact springs 12, 14 project radially out of the base housing 8 and can be electrically contacted via a contact plug (not illustrated). According to the invention, the contact springs 12, 14 are fixed in a form-fitting and force-fitting manner in the base housing 8 by means of a base slide 38 which can be secured in the base housing 8. The contact springs 12, 14 may thus be configured with the retaining region 16 (see FIG. 1) for accommodating the lamp 2 and making electrical contact therewith, in which case the securing of the lamp 2 in the base 1 is significantly improved in relation to the prior art. Furthermore, according to the invention, production of the lamps is likewise significantly simplified in relation to the methods of the generic type, since it is possible to dispense with the separate operating steps for forming a weld. According to FIG. 2, the contour of the base slide 38 is adapted to the contour of the base housing 8 such that the base slide 38 along with the base housing 8 forms a common base surface 40 and side surface 42. As a result, moisture and dirt are prevented from penetrating into the base housing 8 and the service life of the lamp is significantly increased. In the case of the exemplary embodiment shown, the base housing 8 and the base slide 38 are formed from an electrically insulating plastic.

Figure 3:
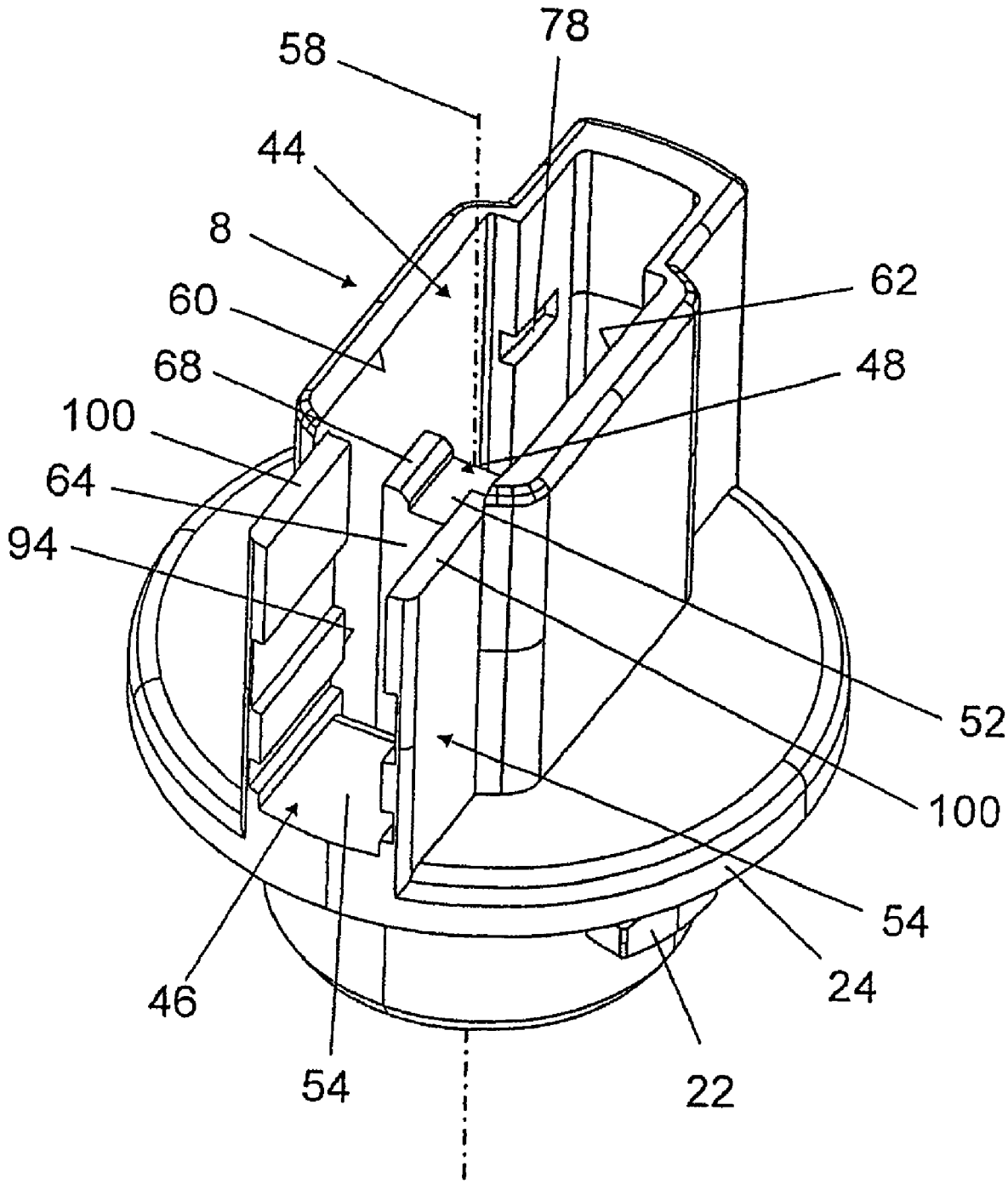
FIG. 3 shows a three-dimensional illustration solely of the base housing from FIG. 2.

As can be gathered from FIG. 3, which shows a three-dimensional illustration solely of the base housing 8 from FIG. 2, this base housing has an accommodating portion 44 which is open at the bottom and on the end side and is intended for accommodating the base slide 38 (see FIG. 2). The accommodating portion 44 contains two approximately groove-like recesses 46, 48 for accommodating the contact springs 12, 14, the recesses being arranged in the base housing 8 such that the contact springs 12, 14 can be brought into abutment against supporting surfaces 52, 54 of the recesses 46, 48 and can be secured between the base slide 38 and the base housing 8 (see FIG. 2). A first recess 46 is arranged in a plug-side end portion 54 of the base housing 8 and is assigned to a first leg 56 (see FIG. 4) of the contact spring 14. The second recess 48 is formed on a connecting crosspiece 64 running between the side walls 60, 62 of the base housing 8, in the direction of a longitudinal axis 58 of the base housing 8, and is assigned to a leg 66 of the contact spring 12 (see FIG. 4). The recess 48 is provided, along the edges, with a chamfer 68 in each case, in order to facilitate insertion of the contact spring 12.

Figure 4:
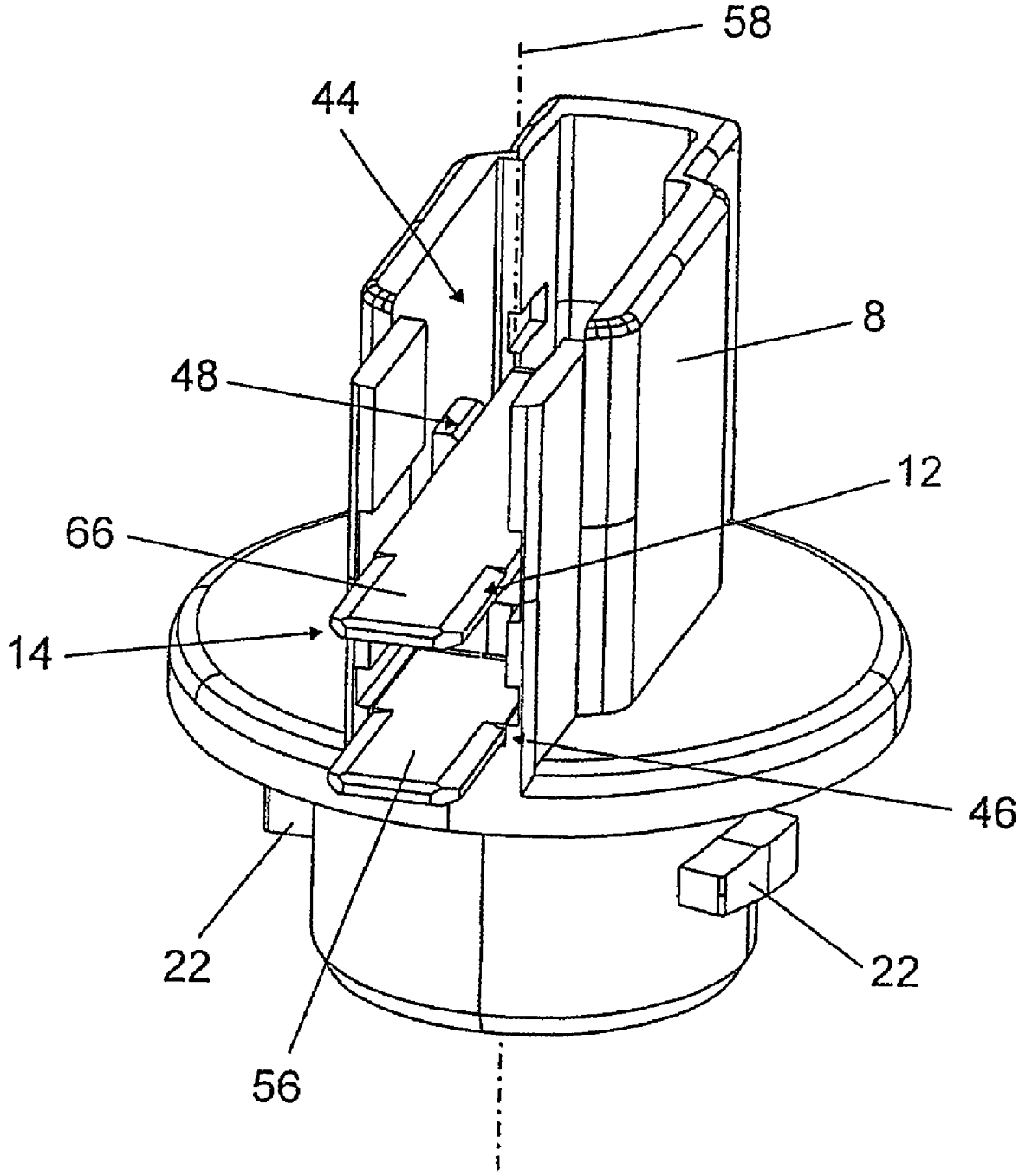
FIG. 4 shows a three-dimensional illustration of the base housing from FIG. 2 with contact springs inserted.

As can be seen, in particular from FIG. 4, which shows a three-dimensional illustration of the base housing 8 with contact springs 12, 14 inserted, the depth of the recesses 46, 48 corresponds approximately to the thickness of the legs 56, 66 of the contact springs 12, 14, in which case the spring legs 56, 66 each terminate flush with the top side of the recesses 46, 48. The contact springs 12, 14 are pressed into the recesses 46, 48 such that the spring legs 56, 66 run essentially parallel to one another and project radially out of the base housing 8.

Figure 5:
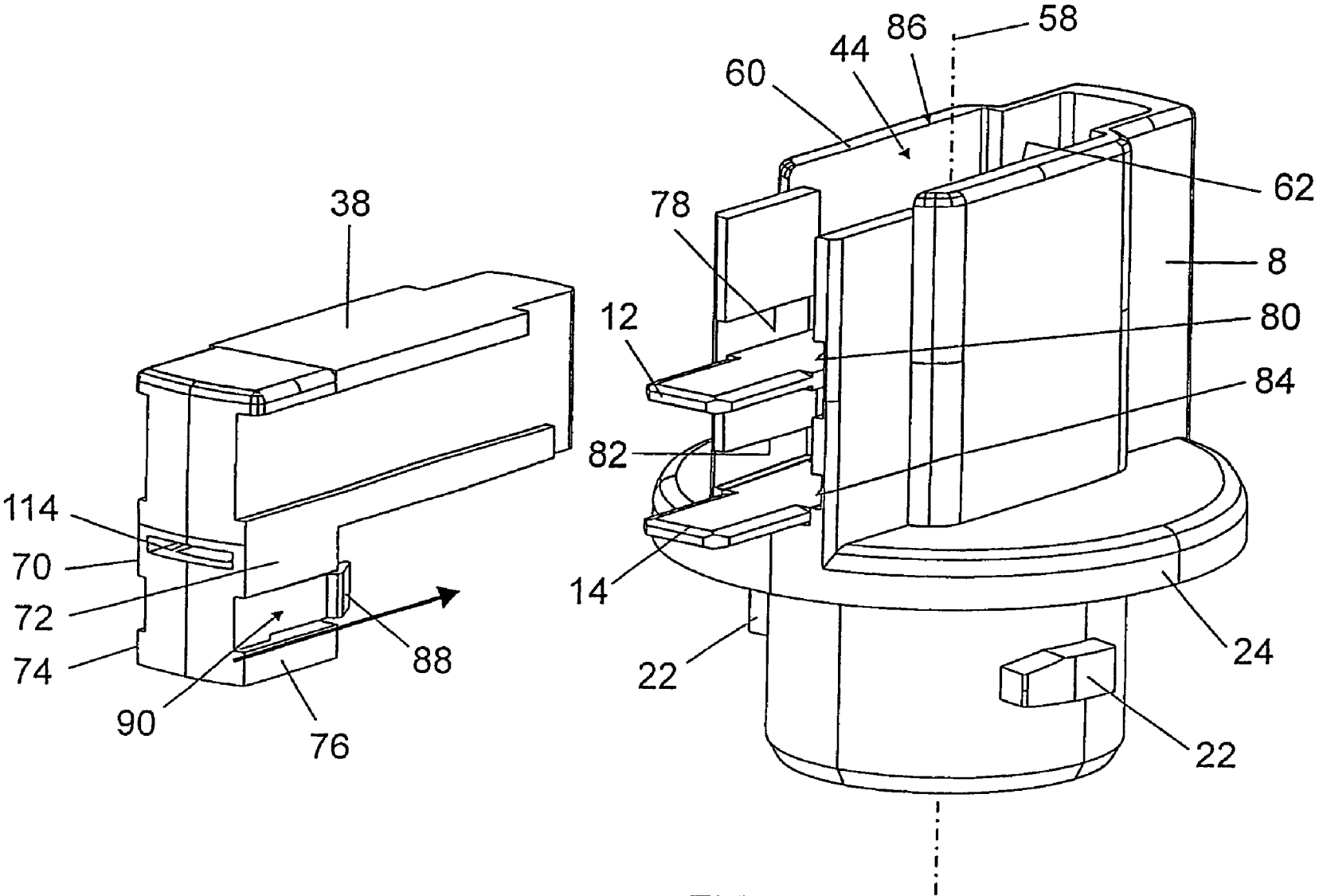

According to FIG. 5, which shows a three-dimensional illustration of the base housing 8, with contact springs 12, 14 inserted, as the base slide 38 is being pushed in, this base slide is pushed into the accommodating portion 44 of the base housing 8 in a radial direction, i.e. 90° to the longitudinal axis 58 of the base housing 8, as is indicated by an arrow. For this purpose the approximately L-shaped base slide 38 has four crosspiece-like guide protrusions 70, 72, 74, 76 which can be introduced into guide recesses 78, 80, 82, 84 of the base housing 8. In the case of the exemplary embodiment shown, the guide recesses 78, 80, 82, 84 of the base housing 8 are in the form of longitudinal grooves which extend, at right angles to the longitudinal axis 58 of the base housing 8, into a radially widened region 86 of the accommodating portion 44. The longitudinal grooves 78, 80 of the base housing 8, these grooves being at the top in FIG. 5, each extends, beyond the radially widened region 44, into the side walls 60, 62 of the base housing 8 (see FIG. 3). The guide protrusions 70, 72, 74, 76 make it easier to push the base slide 38 into the base housing 8, and fix the base slide in the direction of the longitudinal axis 58 in the accommodating portion 44 of the base housing 8. In order to facilitate installation of the base slide 38 in the base housing 8, the two longitudinal grooves 82, 84 of the base housing 8, these grooves being at the bottom in FIG. 5, are formed with a larger cross section than the two longitudinal grooves 78, 80 at the top. The base slide 38 is fixed on the base housing 8 via two locking elements 90, 92 which are provided with a latching nose 88 and are arranged between the guide protrusions 70, 74 and 72, 76 (the locking element 92 is concealed by the base slide 38 in FIG. 5). For this purpose, the locking elements 90, 92 are designed elastically and, once the base slide 38 has been pushed all the way in, engage behind an edge 94 (see FIG. 3) of the base housing 8 via the latching noses 88, in the region between the longitudinal grooves 78, 82 and 80, 84.

Figure 6:
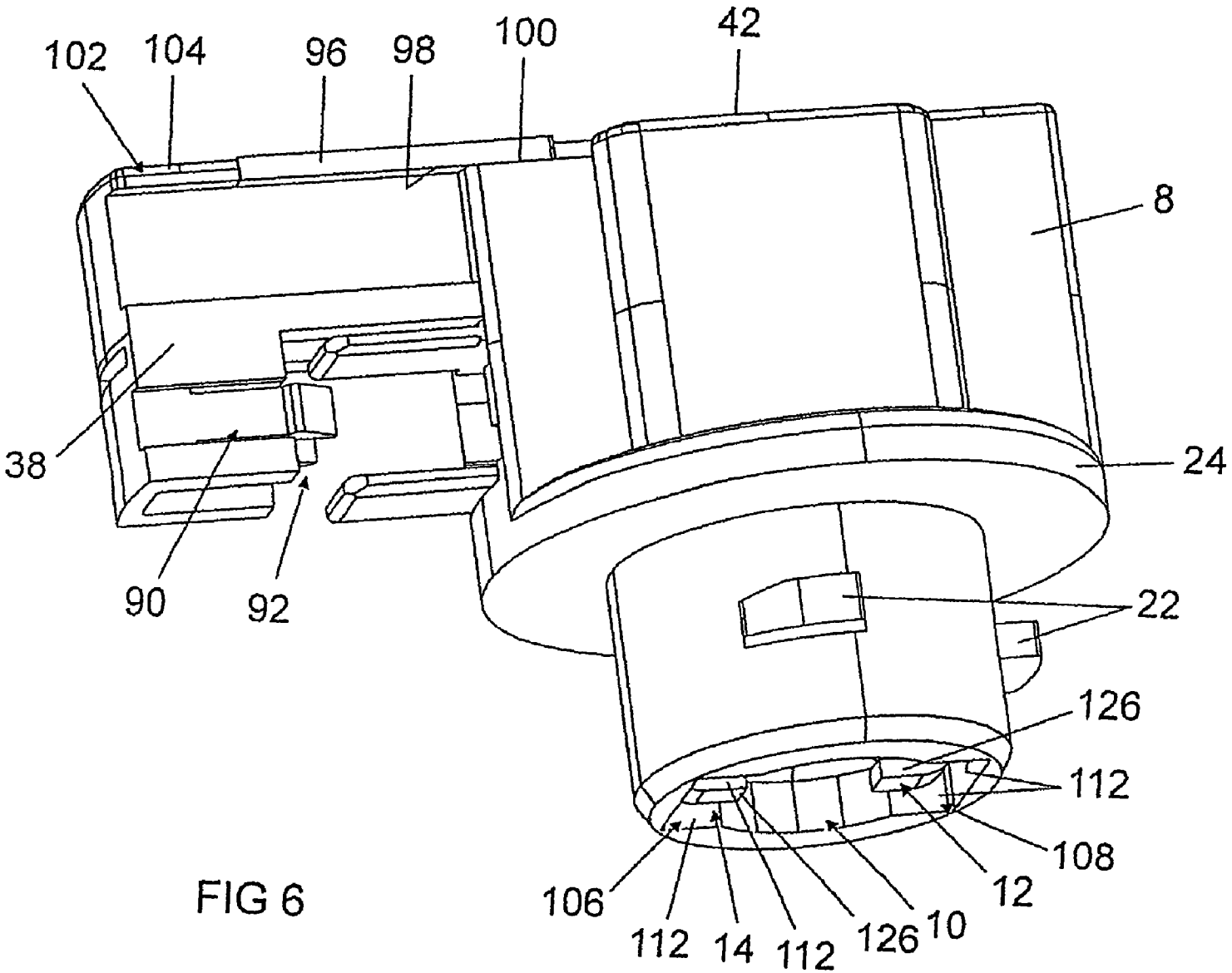

As can be gathered, in particular, from FIG. 6, which shows a three-dimensional illustration of the base housing 8 with the base slide 38 pushed part of the way in, this base slide rests, via a guide surface 98 on the top collar 96 on a supporting surface 100 of the base housing 8, this supporting surface being set back axially in relation to the side surface 42 of the base housing 8, and is guided via this supporting surface as it is pushed into the base housing 8. Once the base slide 38 has been pushed in, a plug-side portion 102 of the collar 96 remains free and, this portion being provided with a rounded formation 104. According to FIG. 6, the installation recess 10 of the base housing 8 is of an essentially circular design and is widened radially via two diametrically arranged rectangular grooves 106, 108. These serve for supporting the contact springs 12, 14 in the installation recess 10. For this purpose, protrusions 126 of the contact springs 12, 14 which are bent through 90° can be brought into abutment against the narrow side 112 of the rectangular grooves 106, 108.

Figure 7:
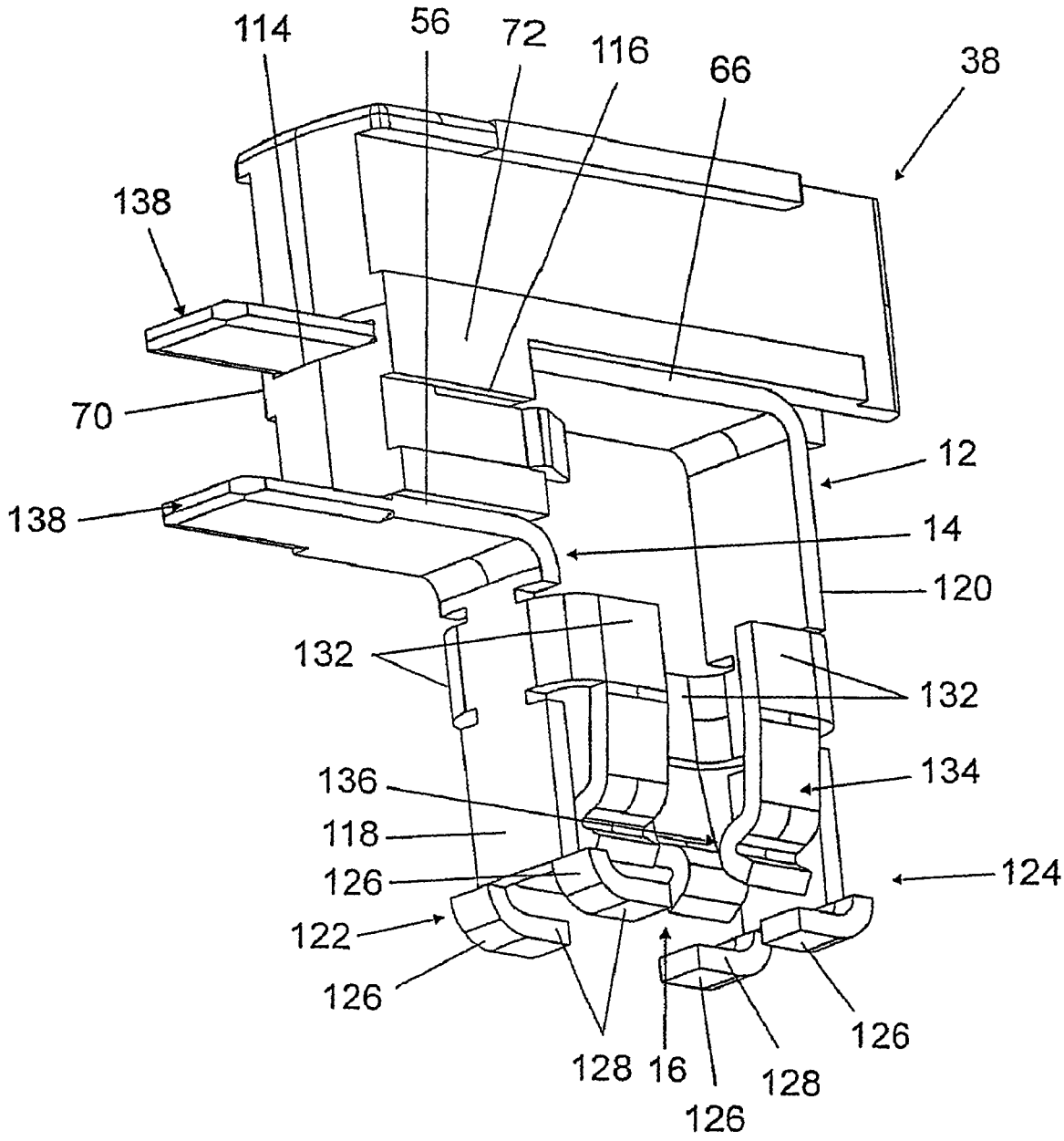
FIG. 7 shows a three-dimensional illustration of the base slide and the arrangement of the contact springs relative to one another in space.

According to FIG. 7, which shows a three-dimensional illustration of the base slide 38 and the arrangement of the contact springs 12, 14 relative to one another in space, the base slide 38 has, in the region between the guide protrusions 70, 72, an essentially slot-like recess 114 for accommodating the legs 66 of the first contact spring 12 and an abutment surface 116 for the leg 56 of the second contact spring 14 (see FIG. 4). As a result, following installation of the base slide 38, the contact springs 12, 14 are retained in the base housing 8 via this base slide, and yielding of the contact springs 12, 14 as the lamp 1 is plugged into the retaining portion 16 is prevented. The contact springs 12, 14 have spring legs 118, 120 which are angled through 90° in relation to the spring legs 56, 66 and, on the lamp side, form the approximately clamp-like retaining portion 16, which can be brought into force-fitting and form-fitting engagement with the pinched portion 6 of the lamp 2 and is in electrical contact therewith (see FIG. 1). The lamp-side end portions 112, 124 of the spring legs 118, 120 each have two protrusions 126 which project beyond the spring legs 118, 120 and are bent through 90° into the retaining portion 16, in which case they form essentially parallel side surfaces 128 for guiding side surfaces 130 of the pinched portion 6 of the lamp 2 (see FIG. 1) in the retaining portion 16. Also formed on the spring legs 118, 120 in each case are two clamp-like spring protrusions 132 which are bent toward one another and merge into hardening portions 134 which run in an axis-parallel manner in relation to the longitudinal axis 58 of the base housing 8 and have a retaining region 136 which is bent in an approximately C-shaped manner. The spring protrusions 132 are brought into abutment against the side surfaces 130 of the pinched portion 6 via the retaining regions 136 and thus fix the lamp 2 in the retaining region 16 (see FIG. 1). The end portions 34, 36 of the spring legs 118, 120, these end portions projecting out of the base housing 8, are provided, on both sides with all-round chamfers 138, which facilitate introduction of the contact plug (not illustrated).

The essential steps for producing the lamp 1 are explained hereinbelow with reference to FIGS. 1 to 5. In a first operating step, the contact spring 14 is introduced into the accommodating portion 44 in the direction of the longitudinal axis 58 of the base housing 8 and brought into abutment against the supporting surface 54. The second contact spring 12 is then pushed into the accommodating portion 44 and brought into abutment against the supporting surface 52 of the connecting crosspiece 64. In the following operating step, as is indicated by an arrow in FIG. 5, the base slide 38 is pushed radially into the accommodating portion 44 of base housing 8. As the base slide 38 is pushed into the accommodating portion 44 of the base housing 8, the leg 66 of the contact spring 12 penetrates into the recess 114 of the base slide 38, and the leg 56 of the other contact spring 14 is guided on the abutment surface 116 of the base slide 38 (see FIG. 7). The guide protrusions 70, 72, 74, 76 of the base slide 38, as the latter is pushed in, are guided in the longitudinal grooves 78, 80, 82, 84 of the base housing 8. Once the base slide 38 has been pushed all the way in, it is fixed on the base housing 8 via the locking elements 90, 92, which are provided with latching noses 88. Finally, the lamp 2 is pushed into the retaining portion 16 of the contact springs 12, 14 via the pinched portion 6 and, on account of the spring action of the fastening portions 134, fixed in the base 1.

The base 1 according to the invention allows a so-called one-touch solution since all that is required, in order to install the contact springs 12, 14 in the base housing 8, is for the base slide 38 to be pushed radially into the base housing, in which case it latches there automatically.

The invention discloses a base 1 for a lamp 2, in particular for a vehicle lamp, having a base housing 8 and at least two contact elements 12, 14 which are fixed in the base housing and are intended for accommodating the lamp 2 and making electrical contact therewith. According to the invention, the contact elements 12, 14 of the base housing 8 are fixed in a form-fitting and/or force-fitting manner by means of a base slide 38 which can be secured in the housing.

The invention claimed is:

1. A base for a lamp, having a base housing, and having at least two contact elements which are fixed in the base housing and are intended for accommodating the lamp and making electrical contact therewith, that wherein the contact elements of the base housing are fixed in a form-fitting or force-fitting manner by means of a base slide secured in the housing, said contact elements being contact springs and said base slide having a slot-like recess for accommodating a leg of a first one of said contact springs and an abutment surface for a leg of a second one of said contact springs.

2. The base as claimed in claim 1, in which the base slide along with the base housing forms a common base surface or side surface.

3. The base as claimed in claim 1, in which the base housing has at least two recesses for accommodating the contact elements, the recesses being arranged such that the contact elements are located essentially parallel to one another.

4. The base as claimed in claim 1, in which the legs of the contact springs are angled in relation to one another.

5. The base as claimed in claim 1, in which the contact springs have at least one spring leg which can be brought into force-fitting or form-fitting engagement with the lamp.

6. The base as claimed in claim 1, in which the base housing is brought into abutment with a vehicle headlight via an annular flange.

7. The base as claimed in claim 1, in which the base housing can be rotated relative to a headlight and can be secured in a releasable manner thereon by means of bayonet closure.

8. The base as claimed in claim 1, in which the base housing or the base slide is made of an electrically insulating material, preferably plastic.

9. The base as claimed in claim 1, further including a lamp.

10. The base as claimed in claim 1, in which the base slide is fixed on the base housing via at least one locking element.

11. The base as claimed in claim 10, in which the locking element has at least one latching nose.

12. The base as claimed in claim 1, in which the base slide is introduced radially into an accommodating portion of the base housing.

13. The base as claimed in claim 12, in which the base slide along with the base housing forms a common base surface or side surface.

14. The base as claimed in claim 12, in which the base slide has a multiplicity of protrusions which can be introduced into recesses of the base housing.

15. The base as claimed in claim 1, in which the base slide has a multiplicity of protrusions which are introduced into recesses of the base housing.

16. The base as claimed in claim 15, in which the recesses of the base housing are longitudinal grooves which extend at right angles to a longitudinal axis of the base housing.

17. The base as claimed in claim 16, in which at least two longitudinal grooves have a larger cross section than the other two longitudinal grooves.

* * * * *